US005558564A

United States Patent [19]

Ascalon

[11] Patent Number: 5,558,564

[45] Date of Patent: Sep. 24, 1996

[54] FACETING MACHINE

[76] Inventor: Adir Ascalon, 35 E. 35th St. Apt. 8H, New York, N.Y. 10016

[21] Appl. No.: 368,423

[22] Filed: Jan. 4, 1995

Related U.S. Application Data

[63] Continuation-in-part of Ser. No. 142,506, Oct. 22, 1993, Pat. No. 5,454,747.

[51] Int. Cl.[6] ..... B24B 7/00

[52] U.S. Cl. ..... 451/066; 451/279; 451/389; 451/449; 451/451; 451/41

[58] Field of Search ..... 125/30.01; 451/41, 451/53, 57, 60, 66, 259, 264, 265, 266, 268, 272, 274, 276, 279, 285, 389, 449, 450, 451

[56] References Cited

U.S. PATENT DOCUMENTS

| | | | |
|---|---|---|---|
| 883,920 | 4/1908 | Stoll | 451/449 X |
| 1,575,156 | 7/1923 | Ecaubert . | |
| 3,279,127 | 10/1966 | Giezentanner . | |
| 3,404,491 | 10/1968 | Emain | 451/389 |
| 3,466,811 | 9/1969 | Suddarth | 451/449 |
| 3,603,042 | 9/1971 | Boettcher | 451/449 X |
| 3,992,820 | 11/1976 | Suter | 451/449 X |
| 4,603,512 | 8/1986 | Cave et al. . | |
| 4,624,081 | 11/1986 | Janutta | 451/279 |
| 4,715,148 | 12/1987 | Landgraf . | |
| 5,313,743 | 5/1994 | Peschik | 451/449 |

FOREIGN PATENT DOCUMENTS

| | | | |
|---|---|---|---|
| 459235 | 12/1991 | European Pat. Off. | 451/449 |
| 222861 | 9/1989 | Japan | 451/449 |
| 1705050 | 1/1992 | U.S.S.R. | 451/449 |

*Primary Examiner*—Timothy V. Eley
*Attorney, Agent, or Firm*—Bachman & LaPointe, P.C.

[57] ABSTRACT

A machine is disclosed for forming facets on the surfaces of a plurality of workpieces. The machine is characterized by the presence of a plurality of pin members for holding the workpieces to be faceted against an abrading surface of a lap or an abrading wheel. The pin members are positioned and held together in a contiguous relationship. The machine also includes a mechanism for setting the angular relationship of the pin members relative to the lap or abrading wheel and for causing movement of the pin members away from the lap. An automated lap cooling, moisturizing and working compound supply system is also provided in another embodiment of this invention, for allowing continuous operation of the machine.

32 Claims, 12 Drawing Sheets

FACETING MACHINE

CROSS REFERENCE TO RELATED APPLICATIONS

This application is a Continuation-In-Part of patent application Ser. No. 08/142,506, filed Oct. 22, 1993, by Adir Ascalon now U.S. Pat. No. 5,454,747.

BACKGROUND OF THE INVENTION

The present invention relates to a machine for shaping or faceting workpieces such as gemstones. The machine may also be used for shaping industrial diamonds and metals such as carbide steel for cutting tools.

Grains in diamonds are unpredictable and locating them is time-consuming. Cutting and polishing in the direction of the grains are impossible, making the faceting of a plurality of diamonds, in one and the same operation, nonachievable for diamonds, in the prior art. Additionally, diamonds are attached to holders usually through a press-pot or some other mechanical system and if glued, the diamonds tend to shift position in the holder on account of the heat generated during the cutting and polishing steps or, they detach themselves altogether from the holders. Diamonds are generally cut and polished manually and in recent years with a robotic machine. However, even with the robotic machine, the diamonds are always cut and polished one at a time.

A variety of machines for faceting and otherwise processing gemstones are known in the art. One such early machine is shown in U.S. Pat. No. 515,595 to Linden. The Linden patent relates to a work-holder for grinding machines used to grind articles such as precious stones. The work-holder for holding the precious stones on the abrading face of a lap or other grinding stone has a series of shafts adapted to be turned in unison, and drops carrying the stones are connected by universal joints with the shafts. A gear system is used to rotate the shafts.

U.S. Pat. No. 3,404,491 to Emain relates to a gem working machine having a plurality of parallel stone-carrying spindles mounted on a frame. One end of each spindle carries a stone to be worked, while the other end is rotated by a driving mechanism.

U.S. Pat. No. 3,940,888 to Wain illustrates a faceting device for gemstones. The device orients a gemstone for forming facets thereon in a plurality of coaxial rows with equal spacing of the facets in the rows. A dop stick is provided on the end of a faceting shaft secured in a quill sleeve rotatably mounted in a faceting head which can be angularly adjusted for different facet rows to be formed. A spring-biased detent trigger is pivoted on the bracket to engage between the teeth of an indexing gear secured on a collar on the quill sleeve near the other end of the shaft. A positioning pin is secured to the collar and projects through the gear. A guide disc having evenly spaced peripheral notches is engaged around and can be rotated on a flange bushing threadably engaged on the quill sleeve adjacent the gear. A coil spring is provided on the bushing for urging the disc toward the gear. The disc has respective holes spaced to receive the pin to establish the angular relationship between the successive rows of evenly spaced facets. The notches on the guide disc move the detent trigger into engagement between the gear teeth for assuring uniform angular rotational steps of the shaft in forming the facets of a particular row.

U.S. Pat. No. 4,603,512 to Cave et al. relates to an apparatus for lapping a facet at the tip of a stylus by softly setting the tip down adjacent a rotating scaife which comprises a movable carriage supported on a platform by a means for translating the carriage along a first horizontal axis. The carriage is moved vertically along a second axis substantially orthogonal to the first axis. A stylus holder in the form of a turret operates to pivot the stylus toward the scaife and is biased by a spring or weight to assure a soft set down of the stylus tip on the scaife. A displacement sensor senses the angular displacement of the holder and generates a displacement signal proportional to the angular displacement relative to a predetermined reference position.

U.S. Pat. No. 4,715,148 to Landgraf relates to yet another gem faceting machine. The Landgraf machine has a main working spindle which can be pivoted in a vertical plane to obtain various inclinations of its axes. The spindle is amenable to height adjustment and is capable of being rotated about its own axis. There is also provided a means for latching the rotational position of the spindle in particular positions as well as in positions in-between the particular positions. The machine has a multiple gem mounting structure which includes a multiple chuck mounting element connected to the spindles for being turned therewith. The mounting structure also has a plurality of bores containing sleeves which in turn receive pin receiving spindles serving as rotatable chucks. It also includes a rotatable and position arrestable actuating element. A cover having a circle of latch bores is provided and a central drive element is coupled for rotation to the pin receiving spindles by means of gear pairs. An indexing pin holds the cover in one of the positions defined by the bores. A plurality of gem mounting pins are directly or, through an adapter element, indirectly mounted to the spindles. For latching the main spindle, one either uses existing latch equipment or integrates the same with the chuck mounting element.

U.S. Pat. No. 3,811,229 to Montgomery also relates to a gem faceter. The Montgomery faceter comprising a pivot block which is vertically movable to various positions. A pivot arm is pivotally mounted at one end to the pivot block. A head is mounted to the other end of the pivot arm and is adapted for movement to various positions about a pivot pin. A dop is mounted in the head and adapted to be rotated about its axis to various positions. An index plate is fixedly mounted on the dop. The index plate has markings thereon which indicate the number and position of desired facets to be ground on a gem held by the dop. An index plate clamp for locking the index plate successively in the desired marked positions relative to the head for grinding the facets is provided.

A lapping table is adapted to be contacted by the dopped gem. A protractor is provided for continuously indicating the angular position of the dop relative to the vertical. An adjustment stop is provided for limiting the movement of the head toward the lapping table. A sensor is mounted on the stop for sensing the degree of movement of the head toward the lapping table. An electronic circuit for translating the degree of movement sensed by the sensor into an electronic signal and a visual indicator for indicating the value of the electronic signal and the degree of the movement are provided so that the faceting angle may be detected and duplicated with a degree of precision.

U.S. Pat. No. 1,575,156 to Ecaubert relates to a machine for grinding and polishing gemstones. The Ecaubert machine has a revolvable lap member together with a revolvable drum or work carrying member adapted to revolve in an opposite direction. The machine is constructed so that the revolvable work member oscillates over the lap member in order to bring the surface of the article to be ground successively into contact with all portions of the grinding surface of the lap member. The oscillating movement is controlled so as to cause a substantially even wear on the entire surface of the lap member.

Despite the existence of these machines for faceting and otherwise processing gemstones, there still remains a need for a machine that is capable of faceting a great volume of workpieces in a relatively small area while having automatic cooling, moisturizing, and working material supply system. One of the problems with prior art machines is the extensive use of gearing arrangements which increased the space occupied by the machine and which prevented workpiece holding tools from being operated in unison. Such machines are only capable of faceting only fifteen stones at a time, because gear technology machines work in a linear formation and extend no more than ten inches. The gears also tend to malfunction quite often because they do not transmit well. In addition, the machines are not automated in terms of cooling, moisturizing and supplying material. Therefore, a factory machine is needed which is substantially automated, increases productivity and is less costly to operate.

SUMMARY OF THE INVENTION

Accordingly, it is an object of the present invention to provide a faceting machine that is capable of processing a great volume of stones in a smaller area.

It is also an object of the present invention to provide a machine as above which is more productive and less costly to operate than prior art machines.

Another object of this invention is to provide a faceting machine having an automated cooling system for an abrading surface and a lubricating and grit compounds supply system for refurbishing the abrading surface of the lap or scaife.

Other objects and advantages of the present invention will become more apparent from the following description and the accompanying drawings wherein like reference numerals depict like elements.

The faceting machine and the cooling system of the present invention attains the foregoing objects and advantages. In accordance with the present invention, a machine is provided for forming facets on the surfaces of a plurality of workpieces and which also may include a system for automated cooling of, lubricating of, and refurbishing grit compounds onto, the lap or the scaife.

The machine includes means for abrading objects to be faceted and means for holding a plurality of the objects against the means for abrading. The means for abrading and means for holding are movable relative to each other. In addition, the machine includes means for cooling the means for abrading.

In one embodiment, the means for holding includes a mechanical arm attached to a housing which encloses the pins. The housing and pins are rotatable adjacent the surface of the means for abrading. The means for cooling comprises a housing and a set of spray nozzles within for directing a coolant against the means for abrading. The housing also includes spray nozzles therein for lubricating and for adding grit compounds to the means for abrading. The coolant, lubricant and grit compounds are supplied from an outside source and directed against the means for abrading via the spray nozzles, as needed.

Other details of the faceting machine of the present invention are set forth in the following detailed description.

DETAILED DESCRIPTION OF THE PREFERRED EMBODIMENT

Figure 1:
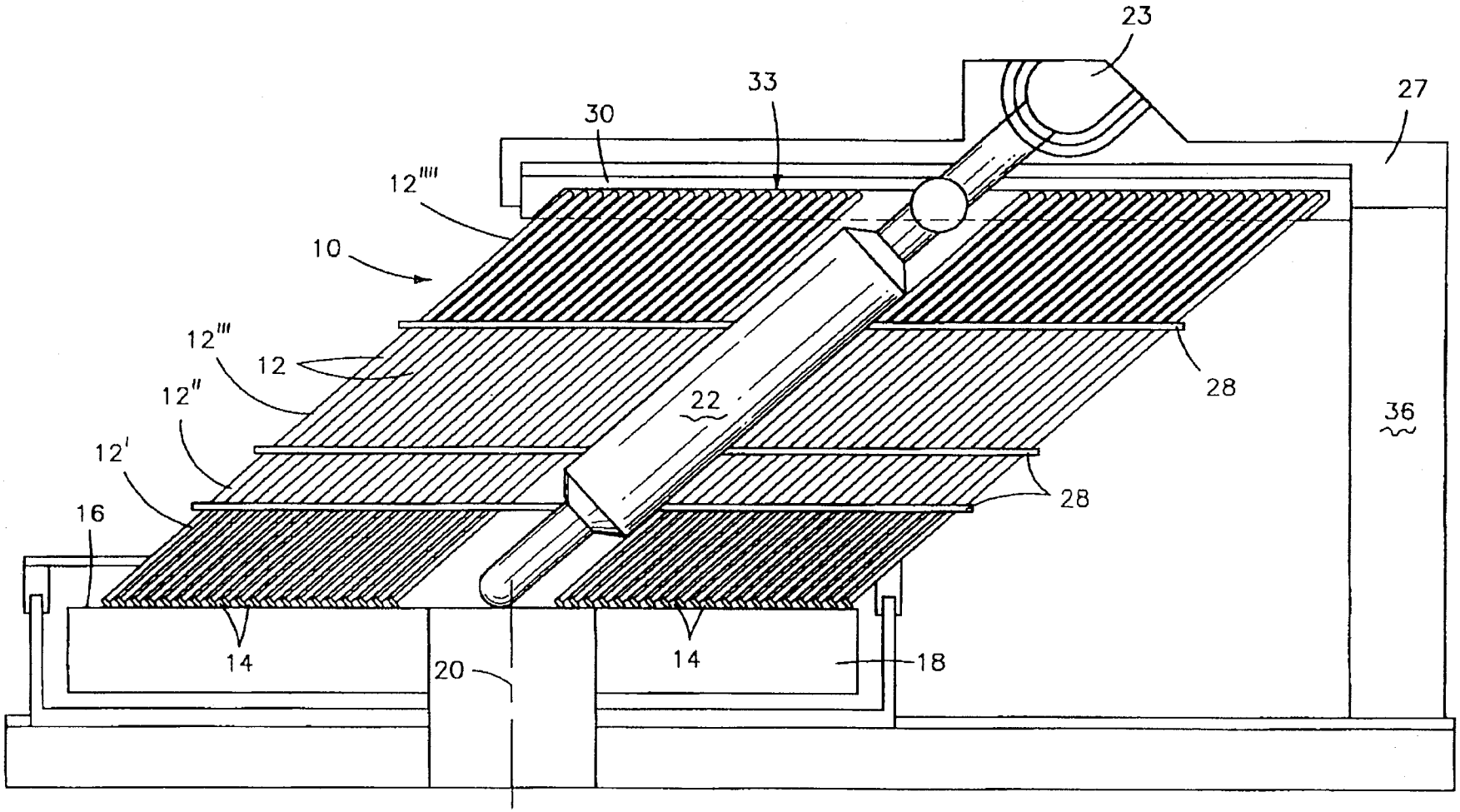
FIG. 1 illustrates a first embodiment of a faceting machine in accordance with the present invention.

Referring now to the drawings, FIG. 1 illustrates a first embodiment of a faceting machine (10) in accordance with the present invention.

The faceting machine (10) has a cluster of pins (12) for holding a number of workpieces (14) such as gemstones, industrial diamonds, or a hard steel workpiece such as carbide steel for cutting tools. The pins (12) are aligned so their longitudinal axes are parallel to each other. Additionally, they are arranged to be contiguous to one another. Still further, the pins (12) have identical outer surface geometries to facilitate any vertical or perpendicular sliding action. Each of the pins (12) may have an outer surface with any desired shape including, but not limited to, a hexagonal or square outer surface.

Figure 8:
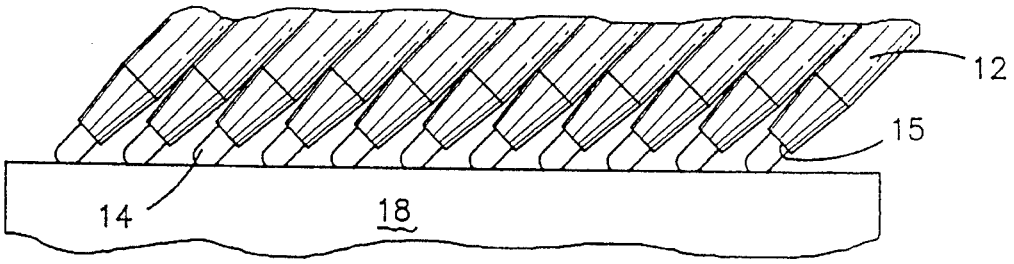
FIG. 8 illustrates the tip portions of the pin members for holding the workpieces.

The pins (12) are used to hold the workpieces (14) against an abrading surface (16) of a cutting lap (18) and to assist in applying shaping forces to the workpieces. To this end, each pin has a hollow tip portion (15) as shown in FIG. 8 for receiving a workpiece (14). The cutting lap is preferably rotatable about an axis (20) by a motor (not shown). When the pins (12) are holding the workpieces (14) against the surface (16), the workpieces all lie in substantially the same plane because the surface (16) is substantially planar.

Centrally located within the cluster of pins is an indexing pin (22). The indexing pin (22) may be pivoted from side to side and from front to back and/or rotated or gyrated through a 360° range of motion. The opposite end of the pin is connected to a servo-control mechanism (23) capable of moving the indexing pin (22) along at least two orthogonal axes. As a consequence of this construction, the upper end of the indexing pin (22) is also movable or gyratable through a 360° range of motion in a plane substantially parallel to the abrading surface (16). The indexing pin (22) is also adjustable over an angular range relative to the surface (16). The servo-control can be operated through any suitable means known in the art such as a programmed computer (not shown). If desired, the servo-control may also be manually operated. In a preferred embodiment of the present, the servo-control is computer assisted.

By changing the angular relationship of the indexing pin (22) with respect to the surface (16), the angular relationship of all of the pins (12) can be adjusted from side to side and/or from back to front. Additionally, by gyrating or rotating the indexing pin (22) in the manner described above, one can cause similar gyrational movement of the pins (12) through a 360° range of motion. Through the combination of angle adjustments and rotational movements, it is possible to form a number of different shaped facets on the workpieces. It is also possible to shape a workpiece so as to form curved surfaces thereon. One of the unique advantages of the present invention is the fact that all of the pins are designed to move together. As a result, substantially the same forces can be applied to each of the workpieces (14) being faceted. Additionally, one pin is equal to the sum of all of the pins.

Figure 9:
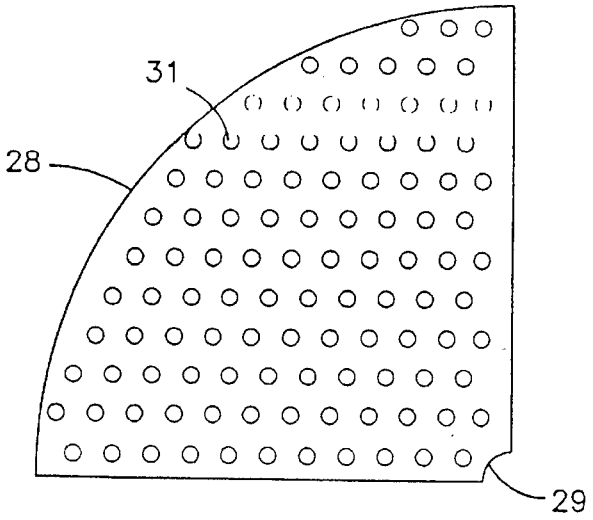
FIG. 9 illustrates a portion of a holding plate for retaining the pin members in a contiguous relationship.

To maintain the pins (12) in contiguous and abutting relationship, a pin retaining mechanism (28), such as holding plates (28), is provided. As can be seen from FIG. 1, three holding plates (28) can be provided along the length of the pins. Each of the holding plates can have any desired exterior shape. FIG. 9 illustrates a portion of one holding plate which can be used to hold the pins (12). The plate includes a central opening (29) for the indexing pin (22) and a plurality of apertures (31) for fitting around recessed portions (not shown) in the pins. When the plate (28) is used, each pin (12) may be formed by a plurality of interconnectable segments (12', 12", 12''', etc.). Where two segments are mated together, the recessed portion is formed. The various segments of the pins may be joined together in any suitable manner such as by mating threads.

In lieu of holding plates (28), the pin retaining mechanism (28) could be a ring shaped member for holding the pins (12) in a contiguous and abutting relationship. For example, the retaining mechanism could be a spring ring, having an open central portion, which fits around the circumference of the pins. A spring ring is one preferred arrangement because it is flexible and capable of holding the pins regardless of both angular changes and positional changes caused by gyration of the pins.

In addition, the pin retaining mechanism includes a top holding plate (30) having a recessed portion (33) for receiving the upper ends of the pins (12) and a series of electromagnets (not shown) for holding the pins in position. The electromagnets may be mounted to the plate or embedded therein. The plate (30) is preferably mounted by any suitable means known in the art to move along at least two orthogonal axes to accommodate movement of the pins.

The electromagnets are used to create a magnetic field which interacts with steel alloy balls (34) at the upper end of each pin (12). As a result, when the plate (30) is moved during angle and degree indexing, the pins (12) will move in unison to the same degree. The plate (30) may be caused to move by the servo-control (23) or some other mechanism.

The machine (10) may also include means (not shown) for moving the plate (30) upwardly and downwardly. Any suitable conventional means known in art may be used to provide the up and down movement of the holding plate (30). Such movement is necessitated in part by the angular changes to the pins (12).

A pneumatic mechanism (not shown) is preferably provided to lower the workpiece loaded pins (12) onto the abrading surface of the cutting lap. The pneumatic mechanism may comprise any suitable pneumatic system known in the art and may be provided within a column (36) attached to the plate (30) by support structure (27). A system for rotating the pins assemblies from side to side or any other angles may also be included.

The pins (12) may be made of any durable material such as bronze, steel or a plastic material. Obviously, when the pins are manufactured without the steel balls (34), the top holding plate does not need to have the aforementioned electromagnets. If the pins (12) are provided with steel alloy balls (34), then the pins (12) should not be manufactured from steel.

Figure 5:
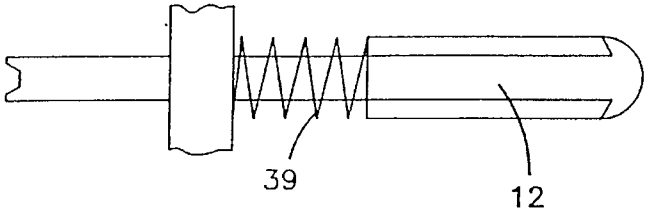
FIG. 5 is an alternative embodiment of a pin construction which can be used in the embodiments of FIGS. 1 and 2.
Figure 4:
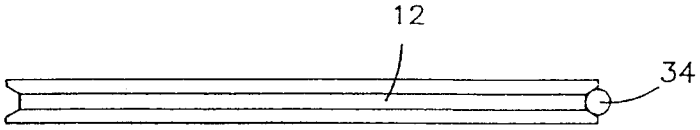
FIG. 4 is a first embodiment of one of the pins used in either of the machines shown in FIG. 1 or FIG. 2.

As shown in FIGS. 4 and 8, each pin may have a hollow tip portion (15) in one end to accommodate the workpiece (14) and the steel alloy ball (34) at the opposite end. As previously discussed, the ball (34) interacts with the electromagnets in the plate (30) as part of the pivoting or rotational movement of the pins. The ball (34) also interacts with the electromagnets in the plate to lift the pins from the cutting lap and for holding the pins rigidly in place against the upper plate. Alternatively, each pin could be shaped in the manner shown in FIG. 5. As shown therein, the pin (12) is rounded at one end to facilitate angle and indexing degree changes. The pins could be hollow if desired for gluing purposes. A spring (39) is provided to keep the pin back towards the top holding plate as shown in the figures. The spring (39) may accomplish this by interacting with a surface of a pin retaining mechanism.

In operation, the stone-loaded pins (12) are lowered onto the rotating, cutting lap (18). During this faceting mode, the cluster of pins (12) move in unison from side to side and/or front to back and/or through all or part of a 360° range of motion to facilitate the cutting process. Once a desired cut is achieved, the pins and the top holding plate (30) are raised. The plate (30) is then disengaged from the pins. When the plate (30) is provided with electromagnets, disengagement is accomplished by shutting the electromagnets off. This allows the pins (12) to be moved to the next desired cut. All of the holding pins (12) are then shifted to a new angle via the rotating indexing pin (22) and the servo-control. Thereafter, the top plate is re-engaged and the pins are again lowered to the cutting lap, in unison, for the next cutting step. This process is continued until the cutting process is completed and the finished, faceted stones have been produced.

Figure 2:
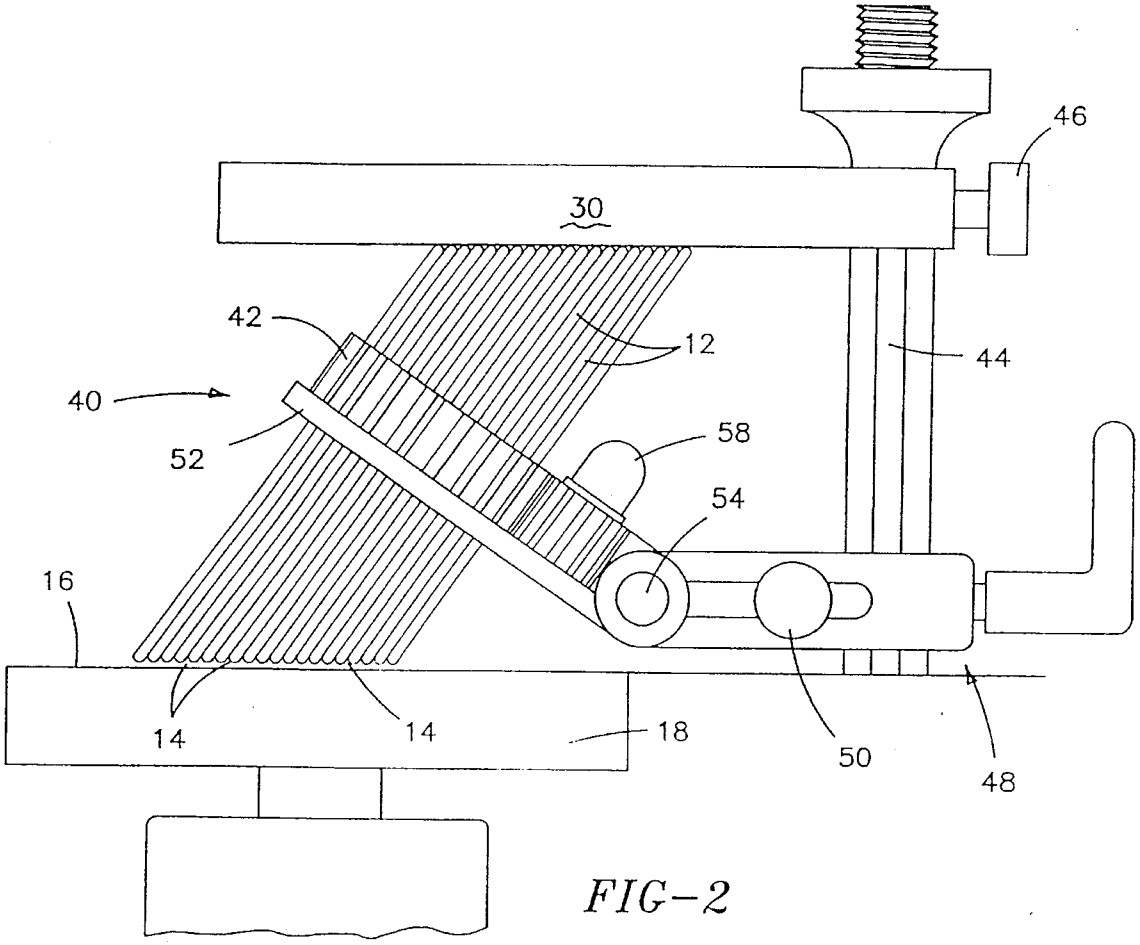
FIG. 2 illustrates a second embodiment of the faceting machine of the present invention.

Referring now to FIG. 2, a second embodiment of a faceting machine (40) is illustrated therein. In this embodiment, the central indexing pin is replaced by a main gear (42) which surrounds the cluster of holding pins (12). The holding pins, as in the embodiment of FIG. 1, have hollow tip portions for receiving a workpieces (14) and are pressable against the abrading surface (16) of a rotating cutting lap by a pneumatic mechanism (not shown).

As shown in FIG. 2, a vertical post (44) is provided along which the top holding plate (30) can be moved up and down. As before, the top plate is configured to receive the upper ends of the pins (12) and to accommodate rotation of the pins. Nut means (46) may be used to permit the movement of the plate (30) along the post (44) and to lock the plate (30) in a desired position relative to the abrading surface (16). A separate pneumatic mechanism (not shown) may be used to automatically position and/or rotate the plate to accommodate rotational movement of the pins.

Also mounted to the post (44) is an adjustment mechanism (48). The adjustment mechanism also slides along the post. A screw-type lock means (50) is provided to fix the adjustment means in a desired position along the post (44). If desired, the positioning of the mechanism (48) can be done automatically by still another pneumatic mechanism (not shown).

As can be seen in FIG. 2, the main gear (42) is mounted on a plate (52) which is hingedly connected to the adjustment mechanism (48) by hinge mechanism (54). The hinge mechanism allows the plate to change its angular position relative to the main body of the adjustment mechanism (48) as the mechanism (48) is moved up and down the post (44).

The main gear (42) has gear teeth around substantially it entire periphery. Additionally, the gear has a central opening (57) for receiving the cluster of pins (12). The shape of the central opening (57) corresponds with the shape of the pins. Thus, for square pins, the opening is square; for hexagonal pins, the opening is hexagonal; and so forth. The main gear (42) also has a series of electromagnets (56) about its periphery for locking the pins in a desired cutting position.

Figure 3:
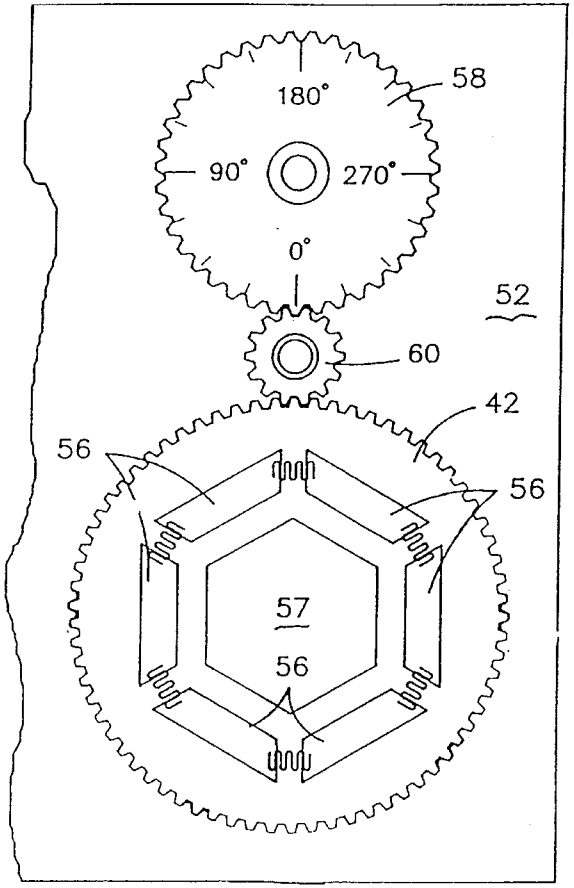
FIG. 3 is a top view of a gear arrangement used in the embodiment of FIG. 2.

As shown in FIG. 3, an adjustment mechanism device (58) is provided to rotate the main gear in a desired manner. The device (58) may be inscribed with degree numbers. The device (58) may be manually operated or may be operated automatically with computer assistance. The device (58) has gear teeth which mate with gear teeth on an intermediate gear (60) which, in turn, has gear teeth which mate with the gear teeth on the main gear (42). The main gear (42) when rotated by the device (58) rotates the pins (12) and thereby achieves faceting in the round. Through the aforementioned means, each rotation is indexed to the correct degree to be faceted. As an alternative to the gears, the rotation could also be performed with a servo control motor.

Figure 16:
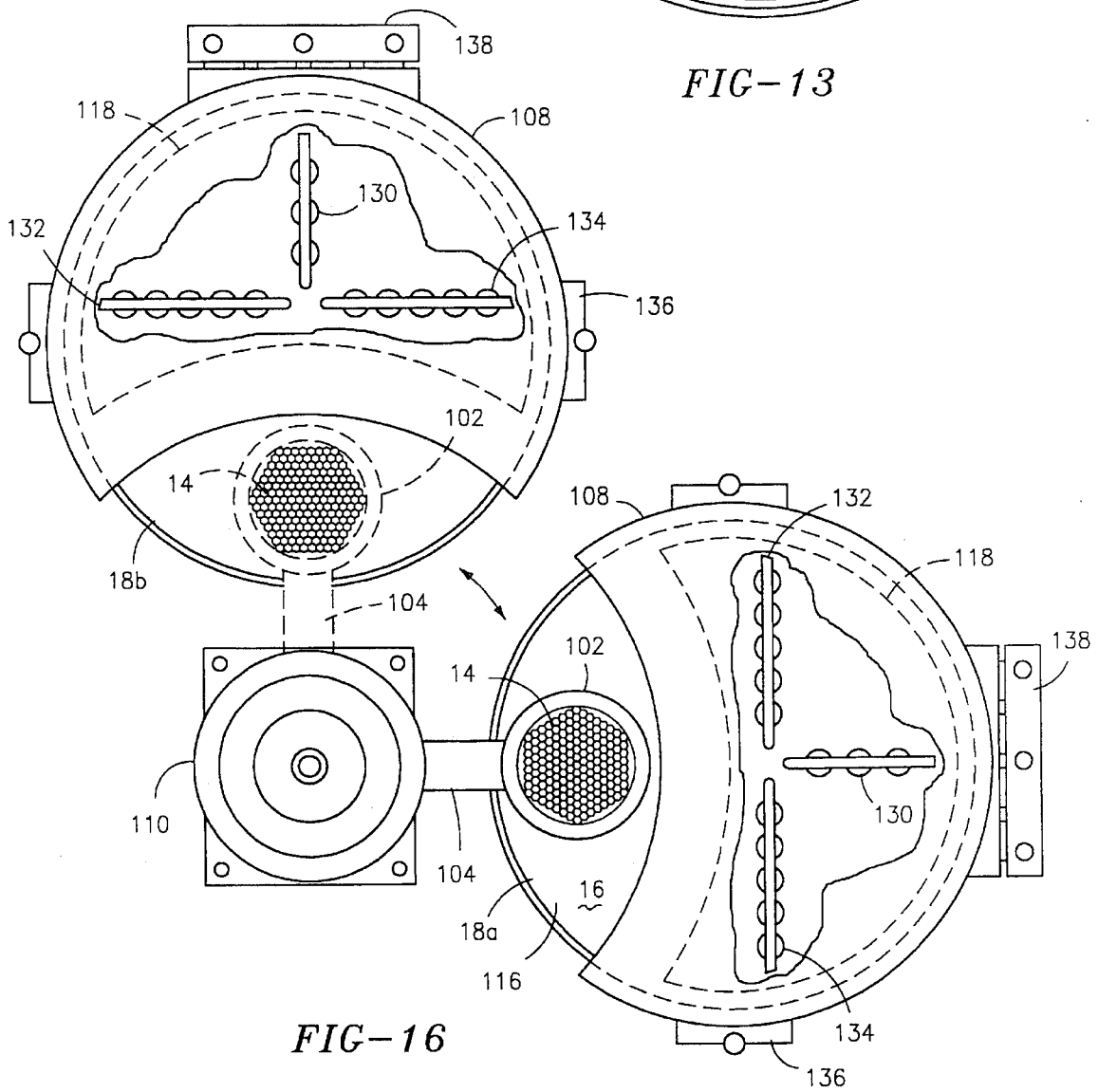
FIG. 16 is a top view of an alternative embodiment of the machine shown in FIG. 14, wherein two abrading surfaces and cooling systems are used.
Figure 14:
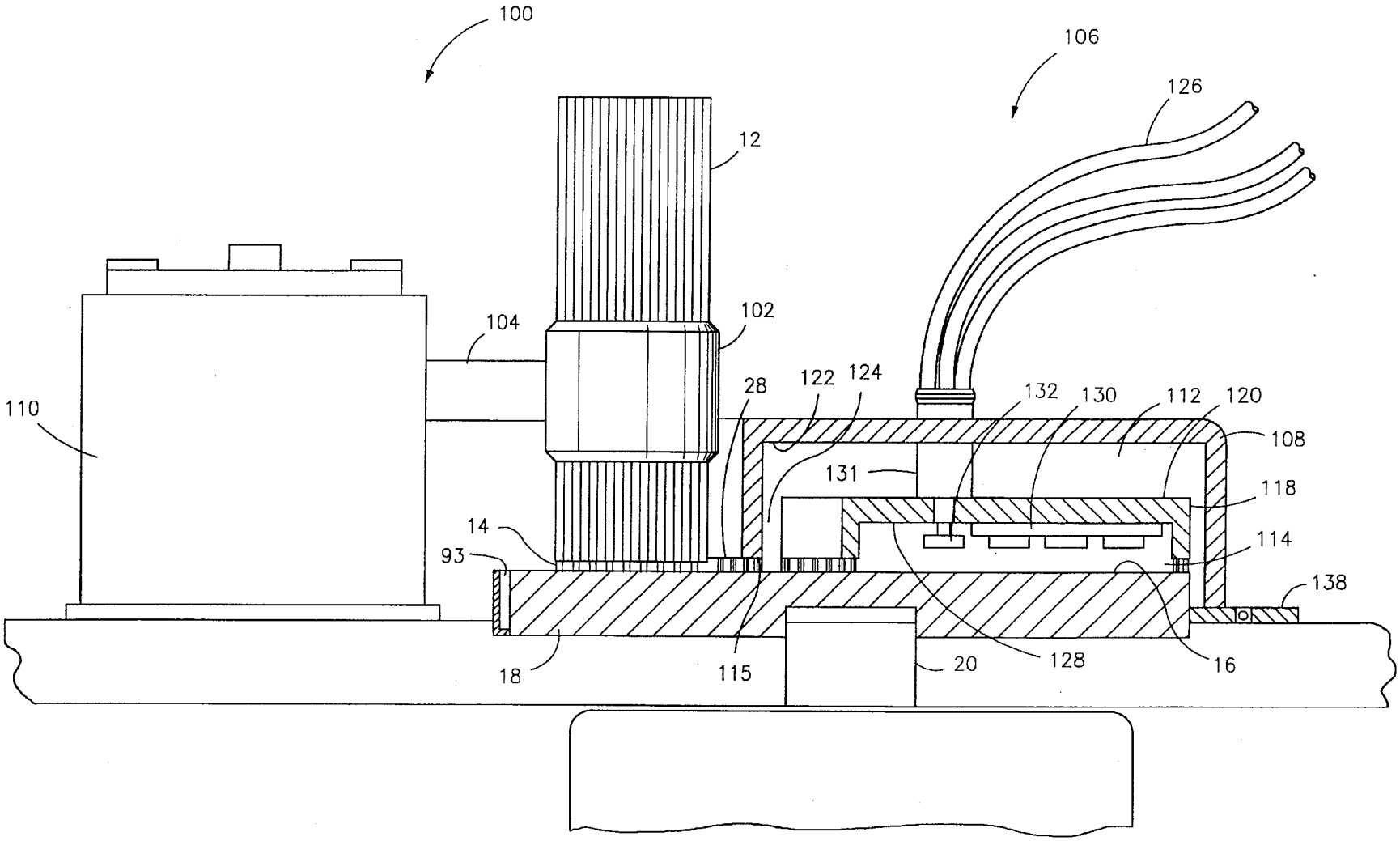
FIG. 14 illustrates an elevational and partially cross-sectional view of another embodiment of a faceting machine in accordance with the present invention, taken along line 14—14 of FIG. 15.
Figure 15:
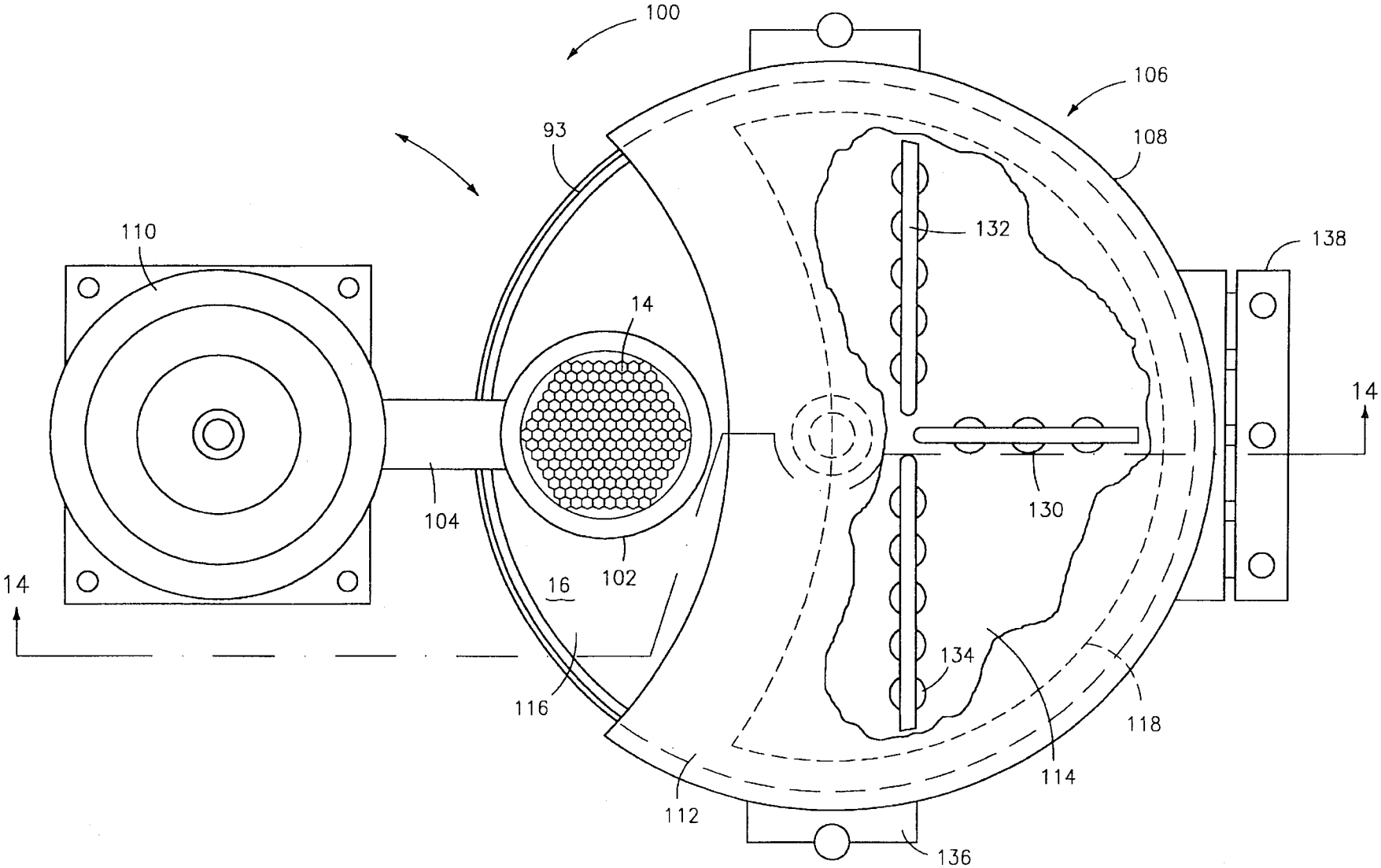
FIG. 15 is a top partially cut-away view of the machine shown in FIG. 14.

In operation, the adjustment mechanism device (58) is moved into a desired position along the post (44). This positions the main gear at a desired angle relative to the surface (16) of the cutting lap. This in turn causes the pins (12) to move to a desired angular position relative to the surface (16). After the main gear (42) has been adjusted, the top holding plate (30) is moved and locked into its position so as to assist in pressing the pins against the abrading surface (16) of the lap (18) and if desired, rotation of the pin assembly from side to side as shown in FIGS. 14–16. The main gear is then rotated by the device (58). This rotates the pins (12) so that an initial cutting of the stones is made along at least one surface thereof. After the desired cut has been effected, the rotation of the main gear is stopped. The top holding plate (30) is raised so as to allow movement of both the pins (12) and the main gear which are then reset to the desired position for the next cut. The top plate is then lowered back into position and the process is repeated until all of the desired cuts are made and the finished, faceted stones are produced.

Figure 6:
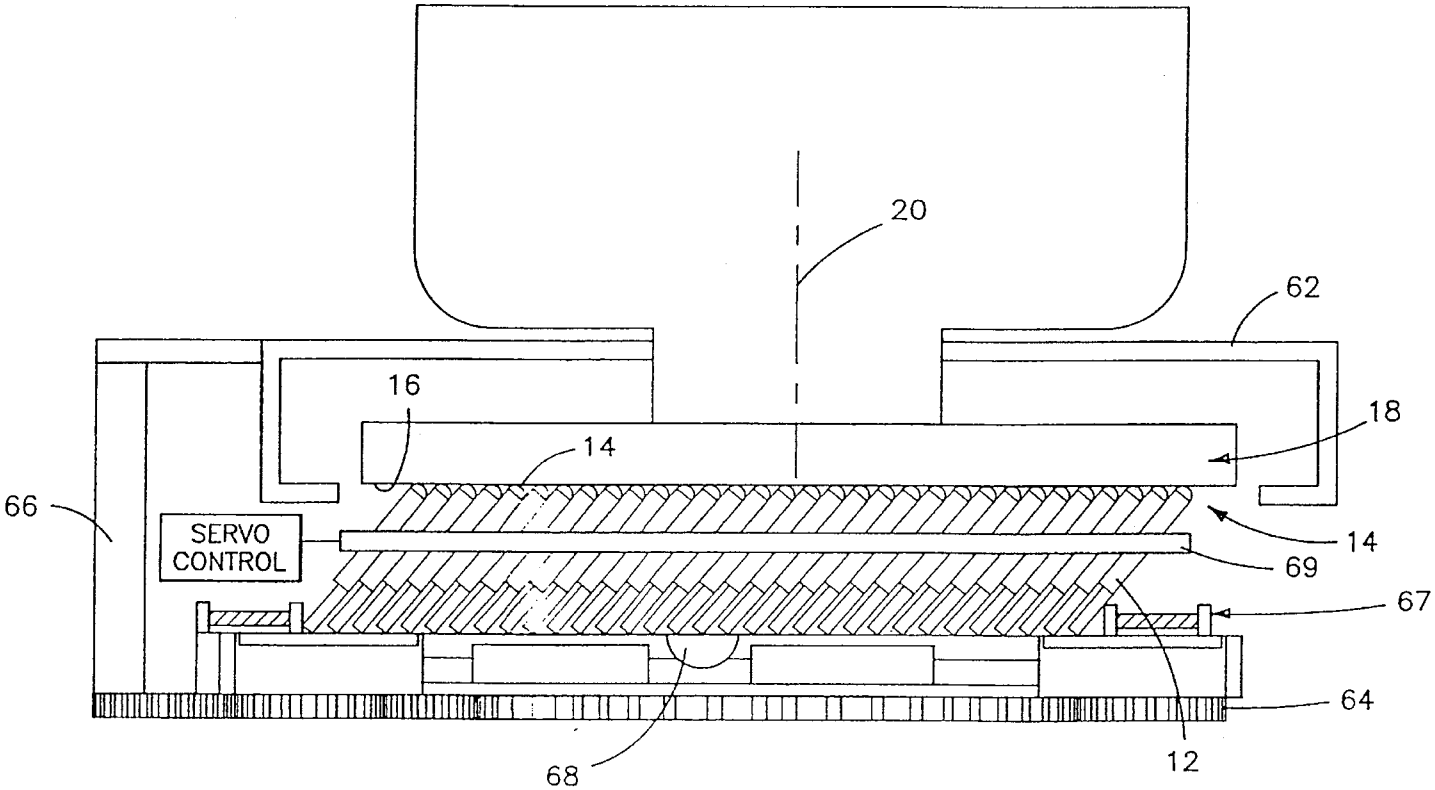
FIG. 6 illustrates a third embodiment of a faceting machine in accordance with the present invention.

FIG. 6 illustrates a variation of the embodiment of FIG. 1 wherein the cutting lap (18) is positioned above the holding pins (12). This faceting machine operates in substantially the same fashion as the machine of FIG. 1. A bottom plate (64), preferably an electromagnetic base plate, is provided to hold tight and release the pins (12) in an on- and off-cycle. The pins are held in place and released by switching on and off electromagnets attached to or embedded in the plate (64).

Figure 10:
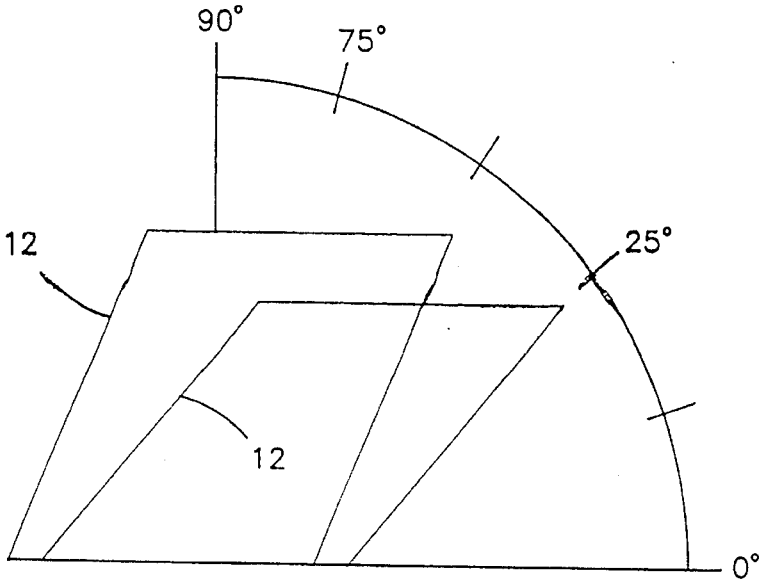
FIG. 10 illustrates the angular movement of the pins in the embodiment of FIG. 6.

The plate (64) is attached to a column (66) in which a mechanism such as a pneumatic device (not shown) is located to move the plate (64) towards and away from the lap (18). An indexing pin (68) is provided to slant all pins at a desired angle relative to the surface (16) of the lap (18). In this device, the pins (12) pivot and are angled towards only one direction as shown in FIG. 10 to achieve the angles of the facets to be cut, and are positioned oblique to the center of lap and/or directed towards center of lap. The pin (68) may be moved by a servo-control device or other conventional control means (not shown).

To hold the pins (12) in place, a holding plate or spring ring (69) is also provided. A border element (67) may also be provided. If desired, a cover (62) may be provided over the lap.

Figure 7:
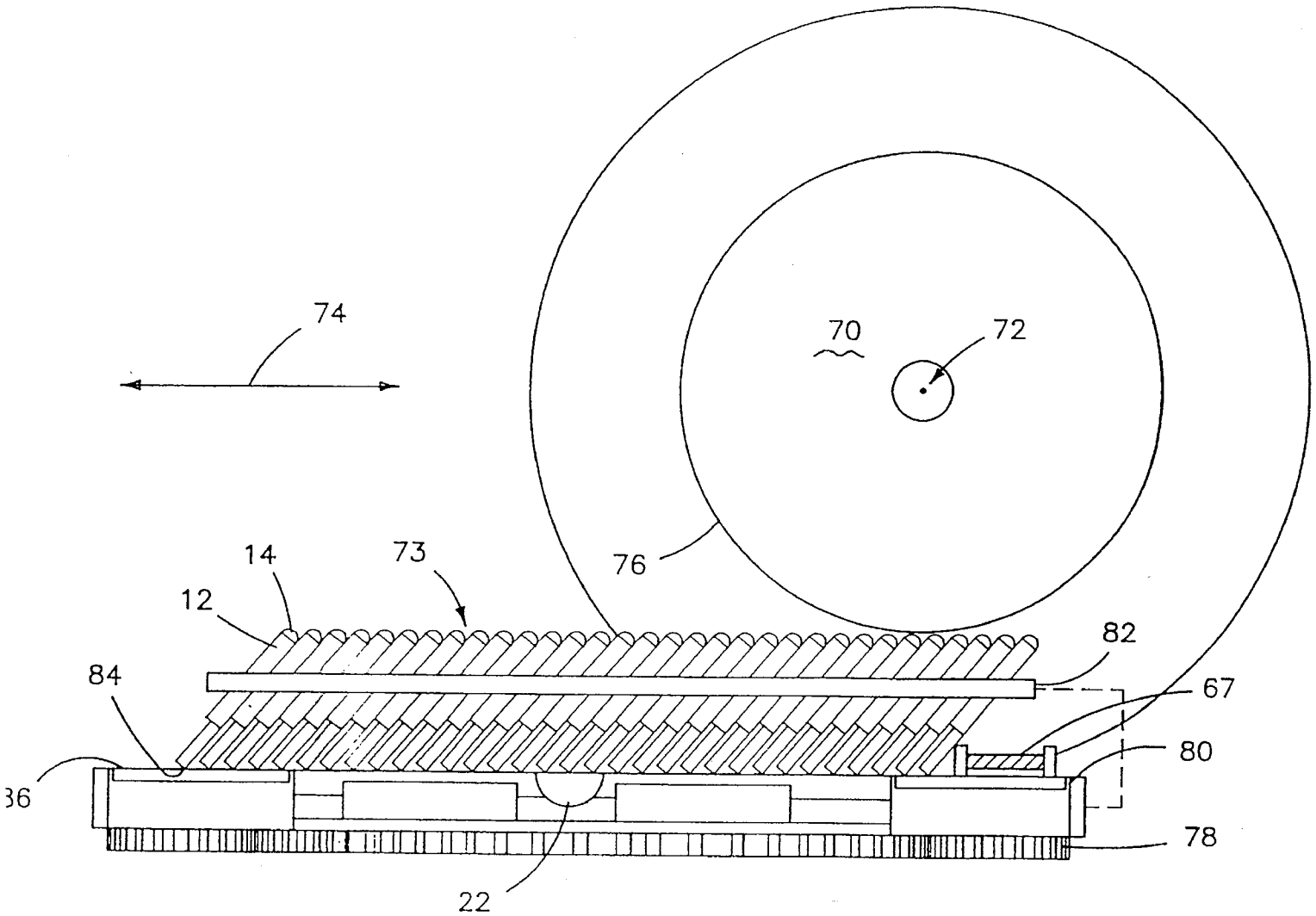
FIG. 7 illustrates a fourth embodiment of a faceting machine in accordance with the present invention.

FIG. 7 illustrates another embodiment of the present invention wherein the cutting lap is replaced by a surface grinding tool (70). The machine (70) rotates about an axis (72) which extends substantially perpendicular to a plane (73) containing all of the workpieces. The surface grinding tool (70) is movable along an axis (74) which is parallel to the surface of the plane (73) containing all of the workpieces. Any suitable means known in the art may be used to move the grinding tool (70) along the axis (74) and cause the cylindrical grinding tool to rotate and cut about the axis (72). Another cylindrically shaped tool could be brought down against the plane (73) for polishing.

As before, the pins (12) are used to hold the workpieces being cut against the abrading surface (76) of the grinding machine. In the embodiment of FIG. 7, the pins (12), affixed by gravity, rest on the bottom of an electromagnetic base plate (78) whose function is to hold tight and release the pins in an ON and OFF cycle. In this embodiment, the cutting action is performed without the side motion used in the embodiments of FIGS. 1 and 2. The cutting action is obtained through the base or means for moving tool (70), being moved along the axis. This is done mainly to facilitate quicker production and larger output.

Figure 11:
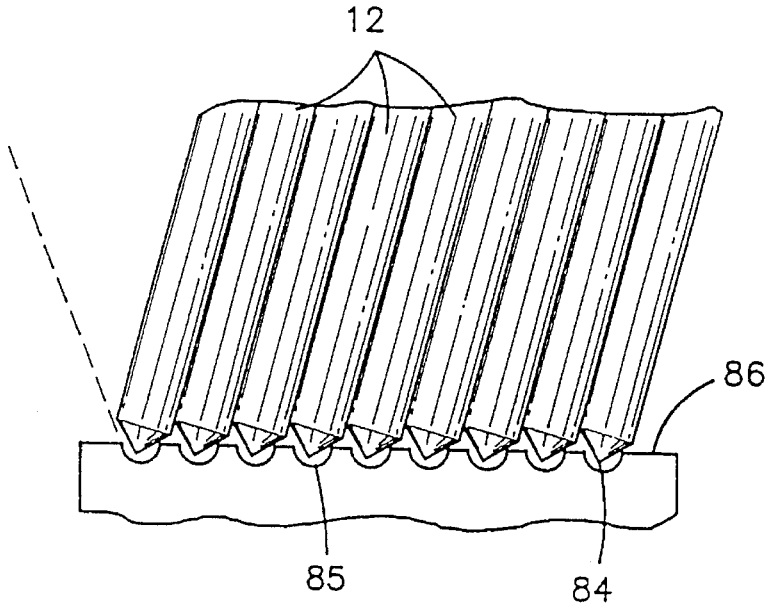
FIG. 11 is an enlarged view of a portion of the machine of FIG. 7.
Figure 12:
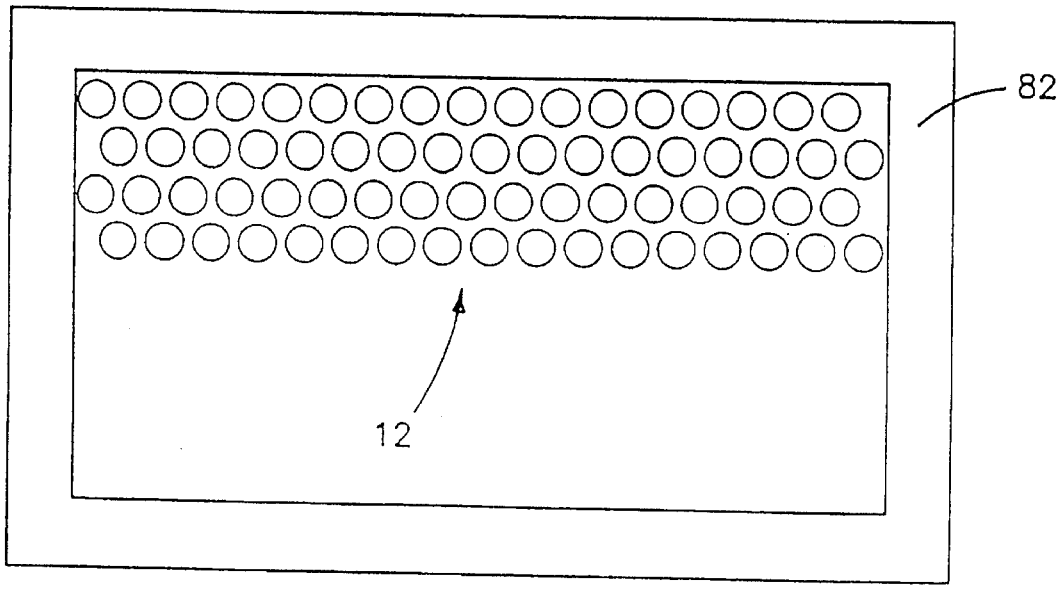
FIG. 12 is a top view of the locking frame used in the embodiment of FIG. 7.

A servo-control mechanism (80) and a locking frame (82) are provided for gyrating the pins (12) in unison on their bottom tips (84) through a 360° range of motion. The pins are held in place against base plate (78) by electromagnets (not shown). As shown in FIG. 11, each pin tip (84) is positioned within a shallow indentation (85) in a surface (86) of the plate (78). The locking frame (82) may comprise any suitable means known in the art to hold the pins together such as a holding plate similar to plate (28). It may be connected to the servo-control mechanism (80) by any suitable means known in the art. The locking frame is driven by the servo-control mechanism (80) along at least two orthogonal axes lying in a single plane to cause the gyrational movement of the pins (12). This embodiment has particular utility in the production of carbide steel cutting or milling tools, diamond tip tools and faceted gems in general.

Figure 13:
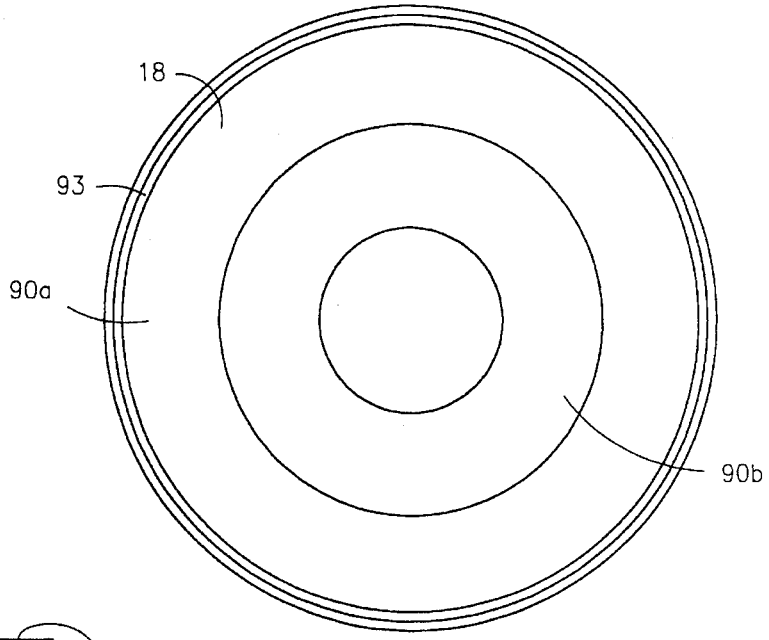
FIG. 13 is a top view of an alternative embodiment of an abrading surface which has areas with different surface textures.

An alternative embodiment of the lap arrangement is shown in FIG. 13, wherein the lap (18) may have different areas thereon specifically designed, as for example, for cutting and polishing. The various areas have or may be adapted to receive thick or fine grit depending upon the function of that area. That is, the polishing area defined by an outer or inner concentric ring (90*a*) has or may be adapted to receive a fine grit and the cutting area, defined by an outer or inner concentric ring (90*b*) has or may be adapted to receive a thicker or thinner grit. The surface (16) of the lap (18) may also be grooved or otherwise textured to trap grit compounds. The grooves allow grit to be trapped or locked into place or embedded in the lap or scaife, during the cutting and polishing operation. For polishing operations, the texture of the lap (18) is substantially plane or smooth. The positioning of the cutting and polishing concentric rings on the lap (18) can be interchanged. In addition, and as shown in FIGS. 13 and 14, the lap (18) may have a channel (93) extending around the periphery thereof for capturing dirt, fluid and other debris which are byproducts from cutting and polishing the workpieces.

Another embodiment of a faceting machine is shown in FIGS. 14–16, wherein this embodiment has a cooling system. The faceting machine (100) has a cluster of pins (12) for holding a number of objects or workpieces (14) such as gemstones, industrial diamonds, or a hard steel workpiece such as carbide steel for cutting tools, similar to as described above. The pins (12) are secured in a housing (102) which is angularly and pivotally movable via a mechanical arm (104). The pins (12) are adapted to place the workpieces (14) against a lap (18), in the form of a scaife or flat, rotatable wheel. The lap (18) may be a polishing lap or alternatively, a grinding or faceting lap. The cooling system (106) is used to cool the lap (18) to prevent overheating of the workpieces (14) and includes a housing (108) for enclosing a large portion of the lap (18), and during rotation thereof, includes means therein for cooling and lubricating the lap (18) and for supplying polishing or abrading materials thereto.

Positioned around the cluster of pins to contiguously hold the same in an abutting relationship is the housing (102). The housing (102) may be rigidly connected to the mechanical arm (104) which is preferably axially and angularly rotatable via a motor (110). As a consequence of this arrangement, the housing (102) is movable through at least a 180° range of motion in a plane substantially parallel to the abrading surface (16).

The housing (102) is also adjustable over an angular range relative to the surface (16) along the axis of the mechanical arm (104) by including therein one of the pin and angle adjusting mechanisms discussed above and represented by FIGS. 1–12. Accordingly, the details of the specification regarding these mechanism is incorporated into this portion of the description for use with the housing (102), mechanical arm (104) and other features of the embodiments of FIGS. 14–16.

By changing the angular position of the indexing pin (22) or by rotating gears (42) with respect to the surface (16), the angular relationship of all of the pins (12) in housing (102) can be adjusted with respect to the surface (16). By rotating the housing (102) in the manner described above, one can cause similar movement of the pins (12) through at least a 180° range of motion, thus rotating the pins from side to side (or along the cutting or polishing axis) among the different functional areas on the lap (18) or for rotating the pins to second or third laps or scaifes, such as the laps (18*a*) and (18*b*), as shown in FIG. 16. Through the combination of axial angle adjustments and rotational movements, it is possible to form a number of different shaped facets on the workpieces (14). It is also possible to shape a workpiece so as to form curved surfaces thereon.

As an alternative to the rotating mechanical arm (104), and for the embodiment shown in FIG. 6 wherein the motor and lap are positioned above the pins (12), the motor and lap can be rotated in a manner similar to that described above for arm (104). That is, while the pins are rotationally stationary, the motor and lap are rotated through an angle to achieve results similar to those obtained by rotating the mechanical arm through an angle.

As an alternative design to the above described singular lap design, the system may include a plurality of laps, arranged as shown in FIG. 16, wherein each lap is designated for a different job, i.e., a polishing lap (18*a*) and a grinding or cutting lap (18*b*). The mechanical arm (104) and motor (110) allows the pin assembly to be moved from the cutting lap (18*b*) to the polishing lap or laps (18*a*), as shown by the dotted lines and discussed below. A third lap (not shown), may be provided for an additional faceting step. The third lap may be used, for example, for the bruting stage. The bruting stage is preliminary to cutting and polishing for preforming the workpiece such as, for example, diamond crystals in preparation for the other steps.

As shown in FIGS. 14 and 15, the lap cooling system (106) preferably comprises a housing (108) which includes a first and outer chamber (112) and a second and inner chamber (114). However, as discussed below, the cooling system (106) can be designed without the inner chamber (114).

Housing (108) has a substantially circular cap shape coinciding with a substantial portion of the polishing lap (18). Preferably, housing (108) sits over lap (18) having vertically extending sides surrounding the periphery of the lap. Brushes (115) or rubber ends (not shown) are securely fastened to the bottom end of the wall for contact with the lap (18), so as to avoid metal to metal or other hard surface to lap (18) contact. The brushes (115) or rubber ends also act as a seal to retain substances released within the housing in a desired location. As shown in FIG. 15, however, the housing (108) does not cover the entire lap (18). The lap (18) has an exposed eye-shaped segment (116), as shown in FIG. 15, which is adapted to be engaged by the workpieces (14) via the faceting machine (100). Accordingly, the peripheral edge and vertical wall of the housing (108) discontinues its circular pattern on the side thereof facing the faceting machine (100) and extends inward towards the center of housing (108) and the lap (18), for exposing the eye-shaped segment (116) of the lap (18). The mechanical arm (104) rotates the housing (102) and pins (12) into and out of engagement with the lap (18) at the eye-shaped segment (116).

The housing is split into the chambers (112) and (114) via an inner housing (118) which is similar in shape to housing (108) yet smaller and shorter in size. Inner housing (118) forms inner chamber (114) and similar to the housing (108), includes brushes or rubber ends on the bottom edge of its vertical walls for allowing nondamaging contact with the lap (18), while providing an effective seal arrangement. The inner housing (118) is connected with outer housing (108) via connectors (not shown) extending between and connected to the walls of each housing. For example, the connectors may extend from the vertical walls of the inner housing (118) into the upper wall of the housing (108). Outer chamber (112) is formed between the upper wall (120) of inner housing (118) and the inner wall (122) of housing (108). Outer chamber (112) includes a channel (124) extending downwardly therefrom, which is in fluid communication with the lap (18). Accordingly, air or any other suitable cooling media is circulated in the outer chamber (112) in order to cool the lap (18). The housing (118) includes a cooling vent aperture (not shown) through which air or other media fed into the chamber for cooling, etc., can be removed. The air or other suitable cooling media is introduced into the chamber (112) from a source (not shown) via any suitable pump and conduit arrangement known in the art.

Figure 17:
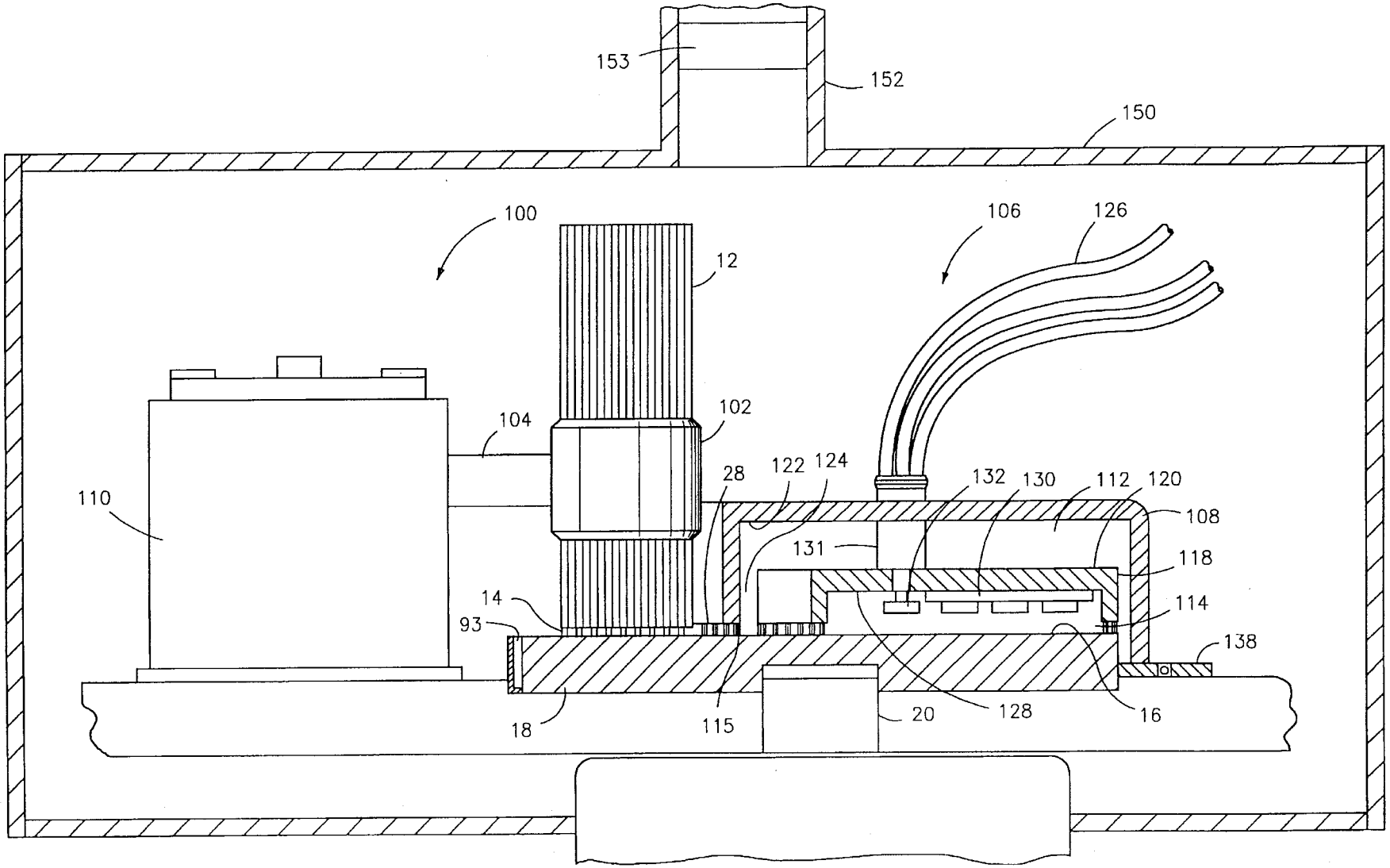
FIG. 17 is similar to FIG. 14 showing an embodiment thereof including an enclosure and filtering system.

A filtering system may also be included for removing toxic vapors created when using a gas coolant. Such a filtering system may be included as part of an additional enclosure (150), as shown in FIG. 17, which functions as a refrigerator of the whole system. Such an enclosure (150) encloses the entire system including the faceting machine and cooling system (106), and is preferably transparent. The enclosure (150) includes a filtering system, in the form of a vent (152) and an additional filtering mechanism, for example, a filter (153) for removing and disposing of any toxic gases used during cooling. Accordingly, the operator is not exposed to such gases.

Inner housing (118) preferably includes a number of spray nozzles therein connected to the upper inner surface (128) thereof as shown in the broken away portion of FIG. 15. Each spray nozzle functions as an injector for providing various substances to the lap (18), wherein the substances are provided through tubes (126). After entering the housing (108), the tubes (126) extend through a cylindrical spacer (131), which extends between and connects housing (108) to housing (118). The tubes (126) and/or cylindrical spacer (131) may also be used to interconnect the housing (118) with the housing (108). The tubes (126) are connected to a material source (not shown) which provides the tubes with the appropriate coolant, lubricant, and grit compound.

Spray nozzle (130) preferably includes a plurality of nozzle heads arranged as shown in FIG. 15, or in any other arrangement, which function to spray diamond polishing or other grit compounds for cutting and polishing such as abrasive grit onto the lap (18) as needed. The spray nozzle (130) is in fluid communication with one of the tubes (126), for receiving the compounds therefrom.

In the embodiment of FIG. 13, where lap (18) has separate areas for polishing and cutting, the nozzle heads of spray nozzle (130) may be used to deliver different compounds and may be aligned with the separate areas such that the correct compound is delivered to each area. That is, some nozzle heads may provide a heavier grit cutting compound to the cutting area of the lap (18) while other nozzle heads may provide a lighter grit polishing compound to the polishing area of the lap (18), defined respectfully in FIG. 13, by the concentric rings (90*a*) and (90*b*). Any sequence can be used to deliver the compounds and the like to different areas of the lap (18). In addition, the cutting or polishing compound can be manually dispensed as needed, if desired. Also, laps can be interchanged for separately performing the necessary functions, if a multi-functional lap as shown in FIG. 3 is not used, and the material dispensed according to the function of the individual lap.

Spray nozzle (132) also preferably includes a plurality of nozzle heads and is positioned within inner chamber (114), substantially adjacent spray nozzle (130). Spray nozzle (132) functions to deliver a lubricant, preferably water, to the abrasive surface (16) of lap or scaife (18). The spray nozzle (132) receives the water from one of the tubes (126) by being in fluid communication therewith for moisturizing surface (16).

Spray nozzle (134) is also positioned in the housing (118), preferably adjacent spray nozzle (130) and substantially in line with the spray nozzle (132). The spray nozzle (134) functions to deliver a coolant to the surface (16) of lap or scaife (18). Spray nozzle (134), similar to spray nozzle (132), preferably includes a plurality of nozzle heads and receives the coolant, preferably freon, from one of the tubes (126). The coolant is preferably atomized and directed at the spinning, centrifugal lap for freezing the compounds and rigidly affixing the compounds in place on the surface (16) of the lap or scaife (18). At the same time, the coolant neutralizes or dissipates the heat generated by the cutting or polishing performed by the lap (18). The coolant helps maintain the stability of the glues used to attach the workpieces (14) to the pins (12), by reducing the heat generated by the contact between the workpieces (14) and the lap or scaife (18), thus assisting in preventing the workpieces (14) from shifting their position or from dislodging.

The particular arrangement of the spray nozzles, as shown in FIG. 15, is by way of example only. Any arrangement of the spray nozzles which properly delivers the coolant, lubricant, and cutting or polishing grit compounds to the lap (18), will suffice. Also, the inner housing (118) can be eliminated from the cooling system, wherein the spray nozzles can be affixed to the main housing (108).

Attached to the outer portion of the housing (108) is a locking mechanism (136) for locking the housing in position over lap (18) during use of the faceting and cooling system. In order to access the entire lap (18) and to access the chambers of the housing (108), the housing (108) can be pivoted upwardly via a hinge joint (138), which is attached thereto preferably in substantially the same vertical plane as mechanical arm (104). By unlocking the locking mechanism (136), the housing (108) can be pivoted upward and away from the lap (18), to expose the chamber (112) and the spray nozzles (130), (132) and (134).

In the embodiment where two laps are used, (18*a*) and (18*b*), for separate polishing and cutting, a cooling system (106) for each lap may be provided, similar in design to that which is described above.

Figure 18:
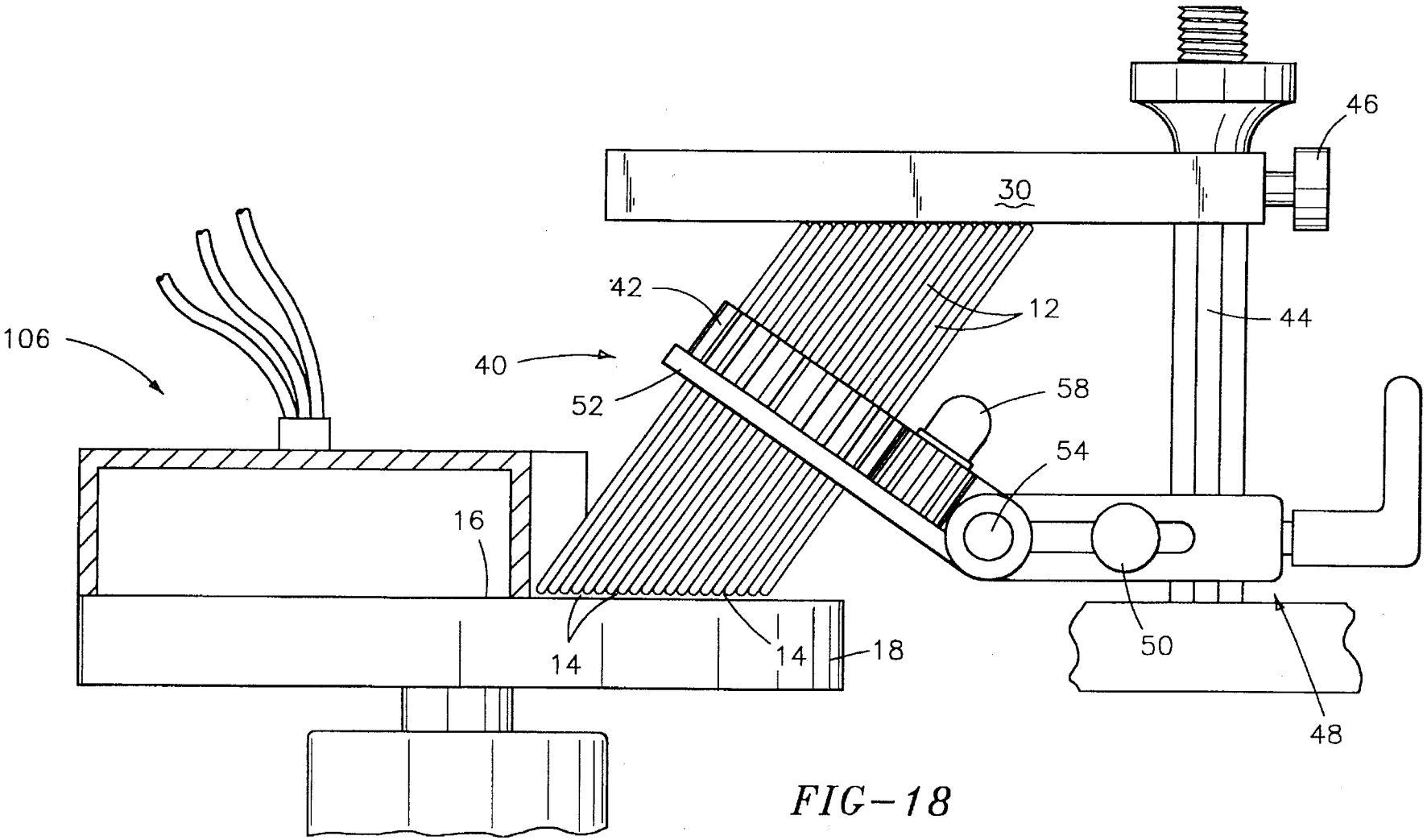
FIG. 18 is an embodiment similar to that shown in FIG. 2 using the cooling system shown in FIGS. 14–17.

In addition, the cooling system (106) described in detail above can be used with the embodiments shown in FIGS. 1–12 and described in detail above. In those instances, it is preferable that the cooling system be placed over the lap or scaife on any side but away from the center point. A simplified embodiment of this arrangement is shown in FIG. 18, where the cooling system (106), as described in detail above, is used with the faceting machine (40) of the FIG. 2 arrangement.

In operation, and referring to FIGS. 14–16, the workpiece-loaded pins (12) are lowered onto the rotating cutting lap (18*b*). During this faceting mode, the cluster of pins (12) move angularly in unison and through all or part of at least a 180° range of motion to facilitate either the polishing or cutting process. Once all desired cutting is achieved, the pins are rotated from the cutting lap (18*b*) to the polishing lap (18*a*), as shown in FIG. 16, via the mechanical arm (104). After polishing, the pins (12) are moved to the next desired cut wherein all of the pins (12) are shifted to a new angle via the mechanical arm (104), the motor (110) and the rotatable housing (102) and placed against the cutting lap (18*b*). This process is continued until the cutting and polishing process is completed and the finished, faceted stones have been produced.

For the embodiment where a single lap (18) is used, as for example, that shown in FIG. 13 having the concentric rings of different texture, once a desired cut is achieved, the pins are moved from the cutting concentric ring (90*b*) of the lap (18) to the polishing concentric ring (90*a*) of the lap (18), via the mechanical arm (104). After polishing, the pins (12) are moved to the next desired cut wherein all of the pins (12) are shifted to a new angle via the mechanical arm (104), the motor (110) and the rotatable housing (102) and placed against the cutting concentric ring (90*b*). This process is continued until the cutting and polishing process is completed and the finished, faceted stones have been produced.

During the facet forming process described above, the cooling system functions to cool the lap (18) or laps (18*a* and 18*b*) while moisturizing and adding polishing compound materials thereto, as needed. As the lap (18) rotates through the housing (108), cooling air is circulated through the upper chamber (112) and against the lap (18), as needed. In addition, the compound spray nozzle (130) provides the polishing and cutting concentric rings, (90*a*) and (90*b*), respectively, or the polishing and cutting laps (18*a*) and (18*b*), with the appropriate compound in an automated fashion, as needed, while water spray nozzle (132) provides moisture to the surface (16) of lap (18), as needed. In addition, nozzle (134) applies a coolant, preferably freon, to the abrading surface (16) of the lap or laps to maintain a low temperature thereof, working in combination with the cooling air being circulated through chamber (112). Accordingly, the entire fastening and cooling system is automated such that the proper combinations and amounts of moisture, polishing and cutting compounds and coolant are used for creating a high performance and high output faceting machine.

Figure 19A:
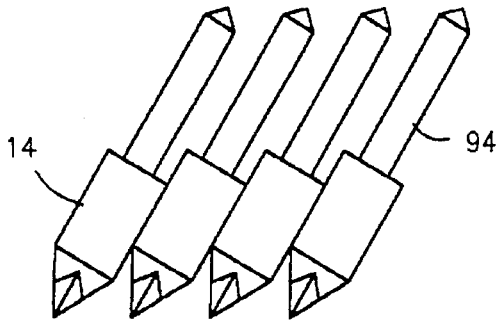
FIGS. 19*a* and 19*b* each illustrate a plurality of workpieces used in a contiguous relationship similar to the pins of FIG. 8.
Figure 19B:
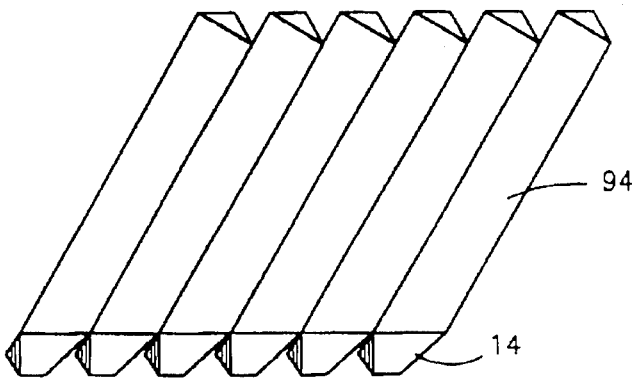
Figure 20A:
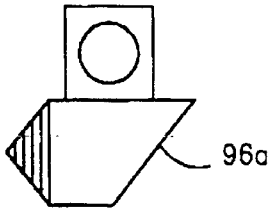
FIGS. 20*a* and 20*b* are illustrative of cutter inserts which can be used with the pins of FIG. 8.
Figure 20B:
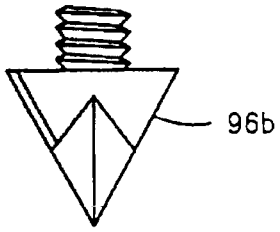

While a plurality of embodiments have been described above for the faceting device as having a plurality of the pins (12), it should be recognized that the workpieces (14) themselves may function as the pins when designed in an elongated manner, as shown in FIGS. 19*a* and 19*b*. That is, the workpieces of objects (14) can include elongated portions (94) which are aligned together in a contiguous relationship similar to the pins (12) of the previous embodiments. The outer surfaces of the workpieces (14) are, therefore, geometrically identical, allowing for the vertical or perpendicular sliding motion discussed above for the pins (12). For this embodiment or for the embodiments above where the workpiece (14) is attached to the pin (12), the workpiece instead of being formed from a crystal gem material, other elements can be used for producing the workpiece (14) such as for example, carbide syndile tipped cutting tool having heads (96*a*) and (96*b*), as shown, for example, in FIGS. 20*a* and 20*b*, requiring faceting. The cutters can be used either as inserts in the form of the cutter heads (96) which are insertable in the ends of the pins (12) or as having the elongated bodies (94) as described herein for use similar to the pins (12).

As can be seen from the foregoing discussion, a faceting machine has been provided which enables a plurality of stones to be cut in an identical fashion at a single time while automatically cooling and supply necessary moisture and grit compounds. As a result, the productivity of the faceting operation is increased and the cost thereof is reduced.

While the present invention has been broadly discussed in the context of faceting gemstones, it should be recognized that the machine could be used to form facets on other types of workpieces such as industrial diamond tools and metals such as carbide steels for cutting tools and other hard steels for cutting and milling tools.

The system described above in detail rectifies the problems with the prior art and has particular use for multiproduction of faceted diamonds, especially smaller sized diamonds. During the faceting modes of cutting and polishing diamonds, the cluster of pins housed in the pin assembly housing constantly rotates from side to side and/or back and front from the center point of the scaife and/or through all or part of a three hundred and sixty degree range of motion, to execute the cutting process, especially when cutting and polishing diamonds. As multidirectional grains are the norm in pluralities of diamonds, by the constant swinging motion of the diamonds on the scaife, cutting and polishing problems that occur inevitably on the peripheral parameters of each diamond in the prior art, are eliminated. Accordingly, all grain directions are encompassed, thus facilitating the cutting and polishing obliquely through the grains.

The cooling system is an integral part of this invention. It is able to control the environment at all times within a housing having spraying assemblies for water moisture and diamond refurbishing grit compounds, so as to affix the grits instantaneously on the lap or scaife. The housing also includes a coolant agent which at the same time neutralizes the heat generated by the cutting and polishing frictions. The cooling system maintains the stability of the glues that prevent the diamonds from shifting or dislodging themselves from the pin assemblies. The swinging robotic or mechanical arm that holds the pin assemblies, and the integral cooling system, are able to realize a uniformity of mass production faceted diamonds, compared to a one-stone, one-machine, one-operator systems of the prior art.

Accordingly, the primary advantage of the present invention is that a faceting machine is provided that is capable of processing a great volume of stones in a smaller area. Another advantage of the present invention is that a machine is provided which is more productive and less costly to operate than prior art machines. Another advantage of this invention is that a faceting machine is provided having an automated cooling system for an abrading surface and a lubricating and materials supply system for refurbishing the abrading surface.

While a number of different ways for faceting workpieces has been described hereinbefore, it should be recognized that the system shown in FIG. 14 could be used to facet workpieces by moving workpieces back and forth in a sweeping fashion across the surface (16) of lap (18). This can be done by using motor (110) to move arm (104), holder (102) and pins (12) holding the workpieces through a desired angular range of motion. It is apparent that there has been provided in accordance with this invention a faceting machine which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A faceting machine comprising:

means for abrading objects to be faceted;

said abrading means having a surface with abrasive grit compounds for abrading said objects;

means for replenishing and refurbishing said abrasive grit compounds on said surface during operation of said abrading means; and means for affixing and freezing said abrasive grit compounds on said surface, said affixing and freezing means comprising means for applying a coolant material to said surface.

2. The faceting machine according to claim 1, further comprising means for lubricating said means for abrading.

3. The faceting machine according to claim 2, wherein said means for lubricating comprises at least one injector for injecting a lubricant.

4. The faceting machine according to claim 3, wherein said at least one injector is a spray nozzle and said lubricant is water.

5. The faceting machine according to claim 1, wherein said means for abrading has a periphery and includes a channel extending adjacent said periphery for capturing fluid and byproducts resulting from cutting and polishing said objects.

6. THe faceting machine of claim 1 wherein:

said abrading means comprises a rotary grinding wheel;

said replenishing and refurbishing means applies abrasive grit working compounds to a surface of said wheel while said wheel is rotating.

7. The faceting machine of claim 1 further comprising:

means for holding said objects against said abrading means; and said holding means comprising a plurality of pins movable relative to said surface of said abrading means, each of said pins holding one of said objects to be abraded.

8. The faceting machine of claim 7 wherein said pins are clustered together and are movable together.

9. The faceting machine of claim 1 further comprising:

a housing positioned over a substantial portion of said abrading means; and said replenishing and refurbishing means and said coolant material applying means being positioned within said housing.

10. The faceting machine of claim 9 wherein said coolant material applying means comprises spray nozzle means for applying atomized coolant material to said surface so as to freeze the grit compounds on said surface and rigidly affix said grit compounds in place on said surface.

11. The faceting machine of claim 9 wherein said coolant material applying means comprises means for directly applying freon to said surface.

12. The faceting machine according to claim 9, further including means for enclosing said means for abrading and said housing, said means for enclosing trapping gases therein and including means for filtering said gases out of said means for enclosing.

13. The faceting machine according to claim 9, wherein said housing includes means for allowing said housing to be moved relative to said means for abrading for openly exposing said means for abrading.

14. The faceting machine comprising means for abrading objects to be faceted and means for holding a plurality of said objects against said means for abrading, wherein said means or abrading and said means for holding are relatively moveable;

means for cooling said means for abrading;

said means for cooling comprising a housing positioned over a substantial portion of said means for abrading, wherein said means for abrading moves through said housing; and said means for abrading comprising a substantially flat and rotatable wheel, said wheel having an area not covered by said housing adapted to engage said objects while being held by said means for holding.

15. The faceting machine comprising:

means for abrading objects to be faceted and means for holding a plurality of said objects against said means for abrading, wherein said means for abrading and said means for holding are relatively moveable;

means for cooling said means for abrading;

said means for cooling comprising a housing positioned over a substantial portion of said means for abrading, wherein said means for abrading moves through said housing and said housing includes a first and a second chamber, wherein said first chamber includes said means for cooling.

16. A faceting machine comprising:

a plurality of angularly adjustable pins, wherein each of said pins has an object to be faceted located at a first end;

a housing for securing said pins together;

at least one movable abrading surface;

a mechanical arm and a motor, wherein said mechanical arm is attached to said housing, said arm and motor adapted to move said pins having said objects located thereon relative to and into contact with said at least one movable abrading surface.

17. The faceting machine according to claim 16, wherein at least said mechanical arm is pivotal for movement of said pins into and out of alignment with said at least one movable abrading surface.

18. The faceting machine according to claim 16, wherein said mechanical arm is axially rotatable for angularly displacing said pins and for achieving a pivotal swinging motion of said pins and said objects, in a plane substantially parallel to said abrading surface.

19. The faceting machine according to claim 16, further including a second abrading surface, wherein said at least one abrading surface has a polishing surface and said second abrading surface has a cutting surface.

20. The faceting machine according to claim 19, wherein said mechanical arm is rotatable between said at least one and said second abrading surfaces, said mechanical arm moving said housing and pins from said at least one abrading surface to said second abrading surface and from said second abrading surface to said at least one abrading surface.

21. The faceting machine of claim 16, further comprising each of said pins having a hollow tip portion for receiving an individual one of said objects.

22. The faceting machine of claim 16, further comprising each of said pin members having an identically shaped outer surface.

23. The faceting machine of claim 22, wherein each pin member has a hexagonally shaped outer surface.

24. The faceting machine of claim 16, wherein said abrading surface comprises a rotating polishing and cutting lap positioned beneath said pin members.

25. The faceting machine according to claim 24, wherein said rotating polishing and cutting lap has a plurality of surface textures.

26. The faceting machine according to claim 25, wherein said plurality of surface textures are defined by separate areas of said lap, said areas comprised of at least two concentric rings on said lap, wherein one ring has a cutting surface and the other ring has a polishing surface.

27. The faceting machine of claim 16, further comprising each of said pins being formed from at least one of steel, bronze and a plastic material.

28. The faceting machine of claim 16, further comprising a second housing, means for cooling, means for lubricating and means for adding compounds to said abrading surface as said abrading surface is received in said second housing.

29. The faceting machine according to claim 28, wherein said means for cooling, means for lubricating, and means for adding compounds are comprised of spray nozzles located in said second housing.

30. The faceting machine according to claim 16, wherein said object comprises a portion of said pin.

31. The faceting machine according to claim 30, wherein said pin comprises a cutting tool and said object is a cutting head integral therewith to be faceted.

32. The faceting machine according to claim 16, wherein said object comprises a cutting tool head inserted into the end of said pin.

* * * * *